US005097394A

United States Patent [19]

Friedlander

[11] Patent Number: 5,097,394

[45] Date of Patent: Mar. 17, 1992

[54] DYNAMIC LIGHT SCULPTURE

[76] Inventor: Paul A. Friedlander, 43 Narcissus Road, London, England, NW6 1TL

[21] Appl. No.: 667,519

[22] Filed: Mar. 11, 1991

[51] Int. Cl.[5] ..... F21V 7/04

[52] U.S. Cl. ..... 362/32; 362/35; 362/322

[58] Field of Search ..... 362/32, 35, 322

[56] References Cited

U.S. PATENT DOCUMENTS

| | | | |
|---|---|---|---|
| 3,766,376 | 10/1973 | Sadacca et al. | 362/32 |
| 3,793,755 | 2/1974 | Gersch et al. | 362/35 |
| 4,364,106 | 12/1982 | Lam | 362/32 |
| 4,814,948 | 3/1989 | Hasegawa | 362/32 |

FOREIGN PATENT DOCUMENTS

| | | | |
|---|---|---|---|
| 202782 | 4/1907 | Fed. Rep. of Germany | 362/35 |
| 424619 | 5/1933 | United Kingdom | 362/35 |

*Primary Examiner*—Carroll B. Dority

*Attorney, Agent, or Firm*—Flynn, Thiel, Boutell & Tanis

[57] ABSTRACT

An elongate element such as a length of nylon cord or fiber optic cable is provided with means attached to at least one of its ends and operable to rotate or otherwise move the same. The moving elongate element is illuminated by illuminating means operable to vary the color of illuminating light either independently of, or in dependence on, the speed of movement of the said elongate element thereby to obtain a constant or varying visual effect.

22 Claims, 7 Drawing Sheets

40
32
II
34
42
44
72
36
38
74
60
III
III
52
48
46
54
II
50

102
34
106
104
72
73
110
108

70
38
60
58
62
30
68
64
48
46
66
56
54

DYNAMIC LIGHT SCULPTURE

BACKGROUND OF THE INVENTION

The present invention relates to light scuptures, light sculptures being structures or articles using light or the properties thereof to generate aesthetically pleasing visual effects. In particular, the present invention relates to dynamic light sculptures which are structures having at least one moving part and means for illuminating the same to thereby generate a visual effect.

SUMMARY OF THE INVENTION

A dynamic light sculpture in accordance with the present invention comprises a first motor having a motor shaft; power supply means for supplying power to said first motor; first mounting means to which said first motor is attached and by which said first motor is supported; a base to which said first mounting means is attached; an elongate element having first and second ends thereof, said first end being coupled with said shaft of said first motor and moved by rotation thereof; and varying-color illuminating means mounted to said base and positioned to illuminate said elongate element with light of varying color.

The controlled variation of the color of light illuminating the elongate body as it moves provides a visual effect. Means for variation of the effect, by altering the rate of color variation and/or the speed at which the elongate element moves, are preferably provided.

The elongate element is suitably a flexible element, such as a length of cord, being rotatably or fixedly attached at one end to the said first motor shaft and at the other end to attachment means which may be movable relative to said first motor shaft. Said attachment means may suitably be the driven shaft of a second motor, to which the element is rotatably or fixedly attached, running at substantially the same speed as the said first motor shaft, although other attachment means may be used and are considered within the scope of the present invention.

The illuminating means are preferably operable to illuminate said elongate element with at least two different colors of light and more preferably with four or more different colors of light.

Control means may be provided whereby the speed of rotation and rate of change of speed of rotation of said elongate element and/or the frequency and rate of change of frequency of color variation may be manually varied, automatically controlled in accordance with predetermined conditions or automatically controlled to vary in response to randomly generated or externally received conditions.

Further particulars and details of the present invention and embodiments of the same may be found in the following detailed description and the claims, the disclosure of which is herein incorporated by reference thereto.

BRIEF DESCRIPTION OF THE DRAWINGS

Embodiments of the invention will now be described by way of example and with reference to the drawings in which.

DESCRIPTION OF THE PREFERRED EMBODIMENTS

Figure 1:
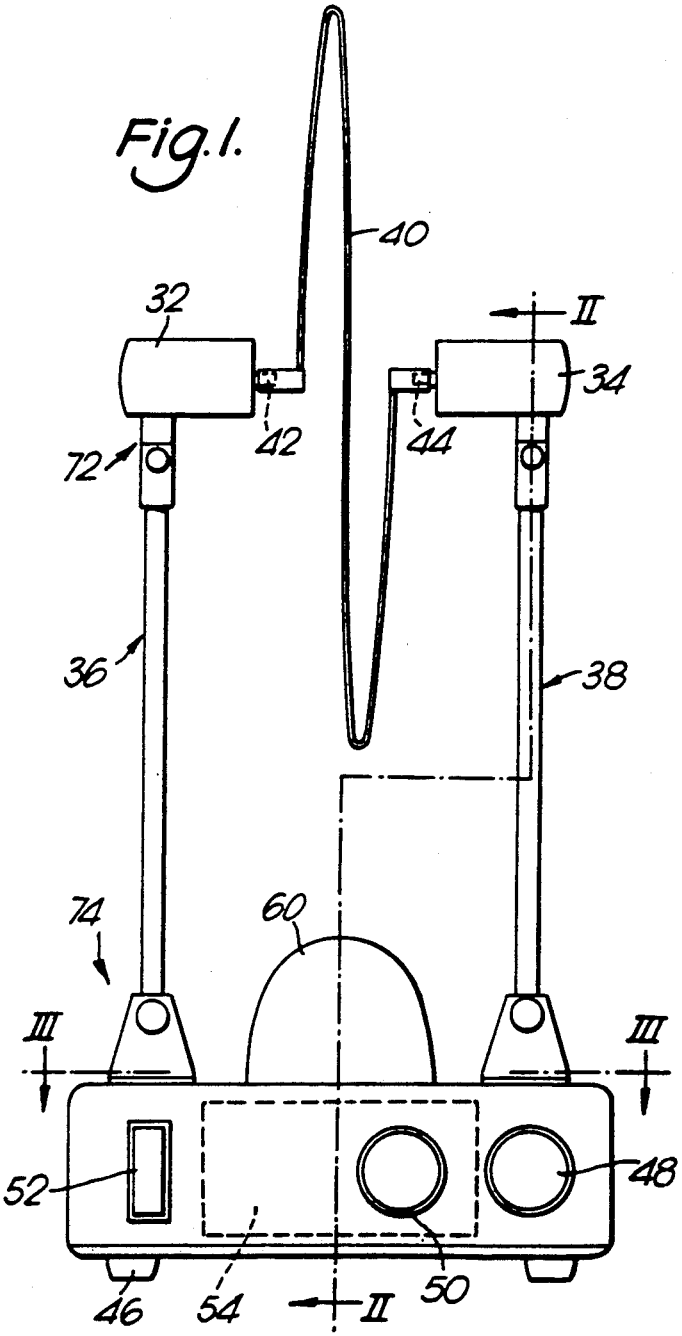
FIG. 1 is a front elevation of a first embodiment of a dynamic light sculpture according to the present invention.

A number of embodiments of a dynamic light sculpture according to the present invention will now be described. Where appropriate, the same reference numerals are used to denote the same parts in separate embodiments where those parts are common to more than one of the embodiments.

Figure 2:
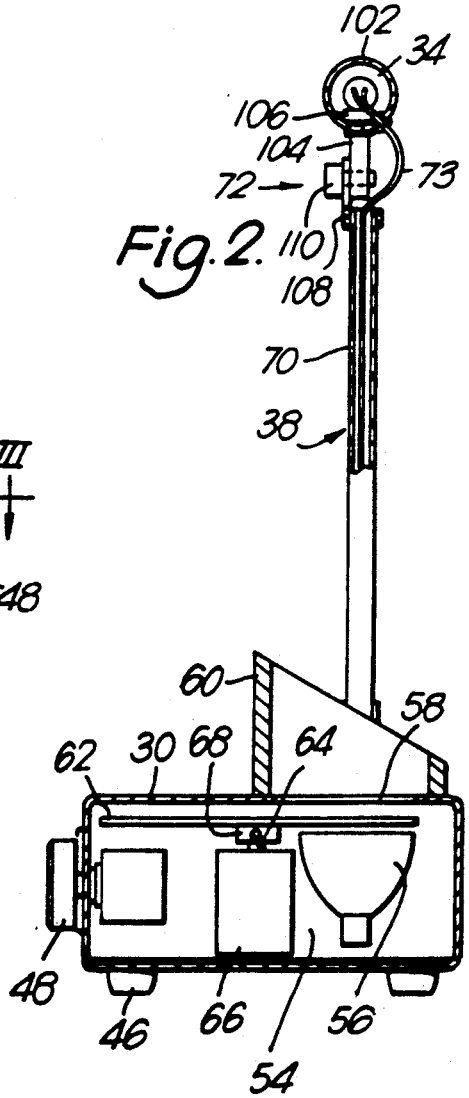
FIG. 2 is a partially-sectioned side elevation of the light sculpture of FIG. 1.
Figure 3:
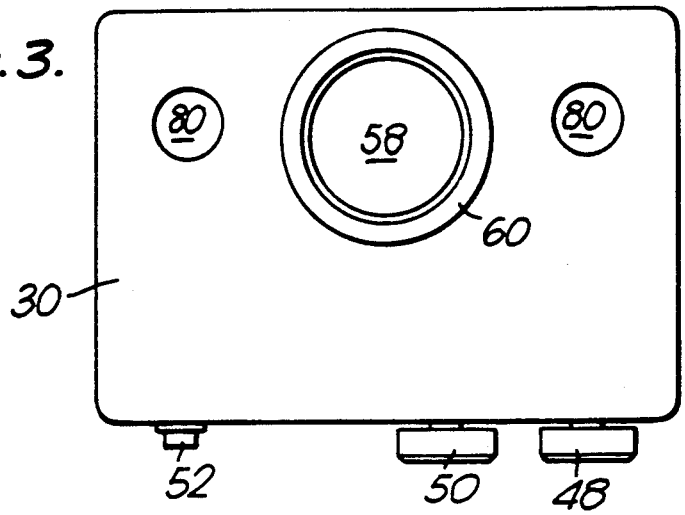
FIG. 3 is a partially-sectioned plan view of the light sculpture of FIG. 1 with the first and second mounting means removed.

A first embodiment of a dynamic light sculpture according to the present invention is shown generally in FIGS. 1 to 3. The light sculpture comprises a base 30 to which first and second electric motors 32,34 are mounted by first and second mounting means 36,38 respectively. An elongate element formed of a nylon cord 40 is attached at its ends to the respective driven shafts 42,44 of the first and second motors 32,34. The length of the nylon cord 40 is several times greater than the distance between the driven shafts 42,44 so that, when the shafts 42,44 rotate, the cord 40 will assume an oscillating profile, one example of which is illustrated in FIG. 1.

The profile assumed by the cord 40 is dependent on a number of factors including the speed of rotation and distance of separation of the motor shafts 42,44. As will be described in detail below, means are provided whereby both of these parameters may be varied to vary the profile assumed by the cord 40.

In a preferred version, motors 32,34 are instrumentation-type precision 0–12 v D.C. servo motors having a low inertia ironless rotor, precious metal alloy commutator and brushes and self lubricating sintered bronze bearings. Suitable motors are the Type 2233 D.C Micromotors marketed by Minimotors SA of CH-6982 Agno, Switzerland. Instrumentation motors of this type, whilst preferred for their quietness and smoothness of operation, are expensive and it will be appreciated that other, less expensive forms of motor may be used. In the latter case, shrouding may be provided to reduce motor noise and vibration-absorbing motor mountings may be used.

In the alternative to instrumentation servo motors, stepper motors may be used with known stepper motor control circuitry to provide accurate motor shaft positioning. In the following description, unless otherwise stated, references to motors will be understood to refer to unstepped DC motors.

The base 30 of the embodiment shown in FIGS. 1 to 3 is a diecast alloy box, dimensions for which are 171 mm wide, 121 mm deep and 55 mm high, with a wall thickness of 1–2 mm. Although a cuboid is shown, it will be appreciated that other sizes and shapes of container may be used to form the base 30. The underside of the base 30 is provided with rubber feet 46. On the front of the base 30, control knobs and switches 48,50,52, whose function and operation will be described below, are positioned.

Within the base 30, illuminating means 54 are provided. A first embodiment of the illuminating means 54 is schematically illustrated within FIG. 2. The illuminating means comprise a lamp 56, suitably a 35 mm diameter dichroic reflector quartz iodide lamp of 20 w power at 12 v. The lamp 56 is positioned to illuminate the nylon cord 40 through an aperture 58 in the upper surface of the base 30. To reduce scattering of light, a cowl 60 is provided on the upper surface of the base 30. The cowl 60 is formed from a section of tubing of circular cross-section having a bore diameter larger than the diameter of the aperture 58. As shown in FIG. 2, the upper edge of the cowl 60 is formed by cutting the tubing at approximately 60° to its major axis.

Between the lamp 56 and the aperture 58, there is provided a disk 62 of clear polycarbonate material. The disk 62 is 80 mm in diameter and is concentrically mounted on the shaft 64 of a motor 66 by means of an alloy bush 68 attached to the disk 62, the bush 68 having a bore for receiving the motor shaft 64 and a locking screw engaged in a threaded bore in the side wall of the bush 68. The motor 66 is a 0–12 v D.C motor and is preferably of the same type as the first and second motors 32,34.

Figure 13:
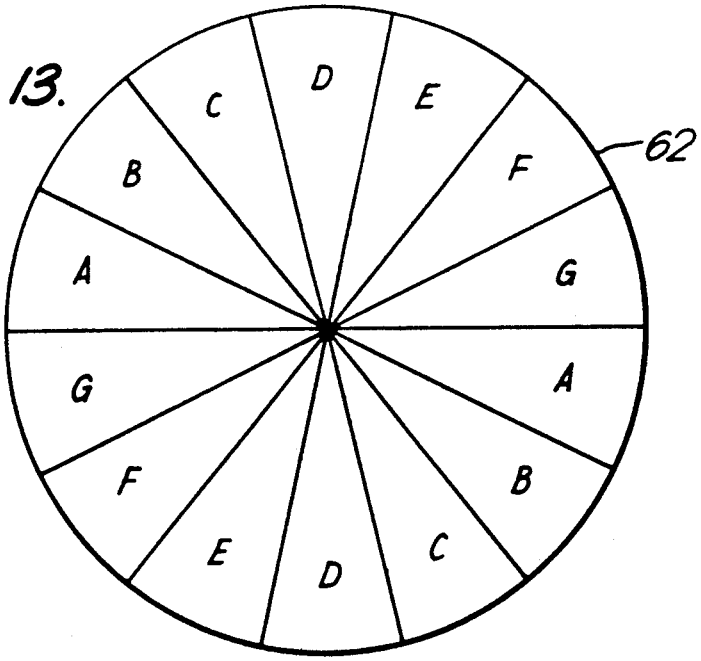
FIG. 13 is a schematic representation of the colored plate used in a first embodiment of illuminating means.

One face of the disk 62 is divided into regions, with each region being covered by a colored gel suitably attached to the disk 62 with clear film-splicing tape. One preferred arrangement of regions on the disk 62 is shown in FIG. 13, wherein the surface of the disk is divided into fourteen equal sectors. A pattern of seven colors (A,B,C,D,E,F,G) is repeated twice such that opposing regions (sectors) have the same color.

When power is supplied to the motor 66 the disk 62 is rotated, thereby bringing successive regions of the disk 62 over the lamp 56 and successively changing the color of the light passing through the aperture 58 to illuminate the nylon cord 40. The visual effect produced, which may be described as being harmonious or chaotic, will be dependent on the speed of rotation of the cord 40 and the speed of rotation of the disk 62 (that is to say the rate of change of emitted light color). The dynamical behaviour of the elongate element is dependent upon the parameters affecting its motion. These parameters include the speed of rotation, the length of the element, the nature of the material it is composed of, its cross section, the distance between its ends, the way it is connected to support points, whether it is driven from one or both ends and the angles of offset of the supporting points.

Under some conditions, its behaviour is harmonic, that is to say that it exhibits sinusoidal waves. Under other conditions, its behaviour is chaotic, that is to say, subject to the laws of chaos.

A sinusoidal wave has a distinct frequency. For this reason, when the dynamical behaviour of the elongate element is harmonic, a steady or harmonious effect is produced when the cord 40 and disk 62 are rotating at the same speed or in exact harmonic relation to one another, whereby, due to persistance of vision, a virtual volume will appear with a steady pattern of colours on it. This virtual volume is the space mapped out by the motion of the cord 40.

When the dynamical behaviour is chaotic, the virtual volume is likewise chaotic. Chaotic motion does not have a distinct frequency and therefore the variation of the relative speeds of the cord and disk will produce a variety of effects but the patterns will not be steady. The applicant considers the most aesthetically pleasing effects, illustrating the interplay between chaos and harmony, are obtained when the cord rotational speed is slowly varied relative to the disk rotational speed. Such variation, which may be due to internal control means or external forces affecting rotation of the cord, produces a display of changing light and colour which, from time to time will settle to a harmonious display before again becoming chaotic. In order to maintain harmonious (non-shifting) operation, should this be desired, the motors 32,34 rotating the cord 40 and the disk motor 66 may be synchronised. Where the cord motors 32, 34 and disk motor 66 are stepper motors, synchronisation may be simply achieved by the sending of the same step command or voltage pulse to each motor. Where the motors 32, 34, 66 are conventional unstepped motors, the easiest way to achieve synchronisation is to connect all three motors 32,34,66 in parallel to the power supply: trimmers may be provided to allow minor adjustments to individual motors to compensate for varying performance between the motors. It has been found that such trimmers are not generally required for synchronisation of the first and second motors since torque in the rotating cord will be sufficient to cause the respective motor shafts to rotate at substantially the same speed. As will be appreciated, slight variations in speed will produce chaotic effects as described above.

Figure 4:
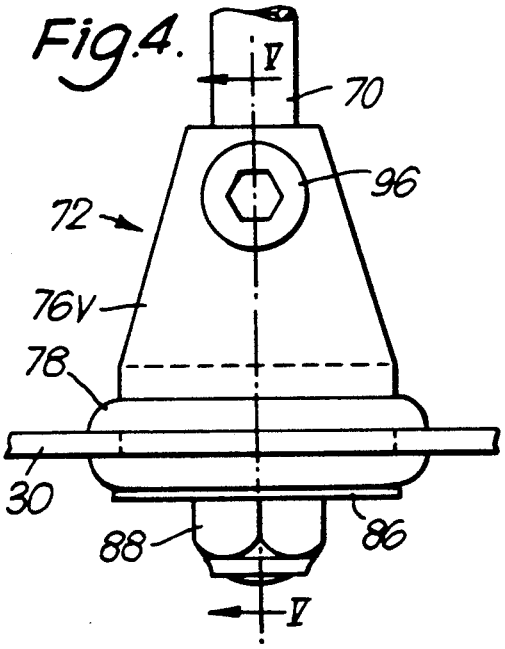
FIG. 4 is an enlarged front elevational view of a part of the mounting means of FIG. 1.
Figure 5:
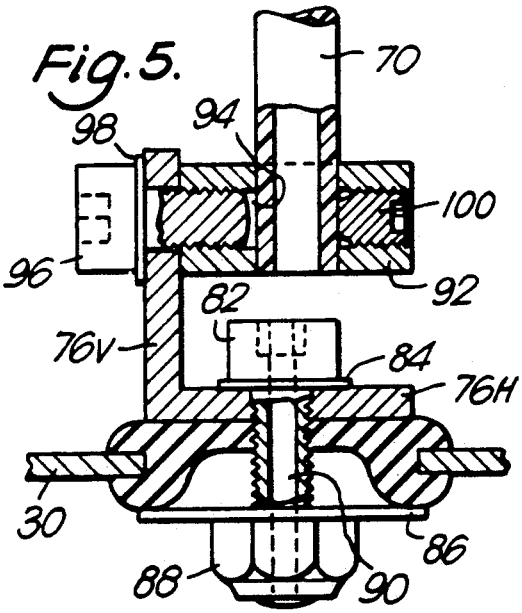
FIG. 5 is a sectional side elevation of the mounting means part of FIG. 4.
Figure 6:
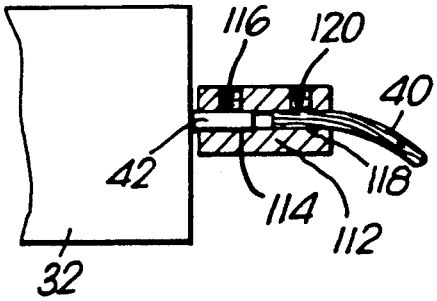
FIGS. 6 to 11 show respectively six alternate methods for attachment of the elongate element to the motor shaft.
Figure 7:
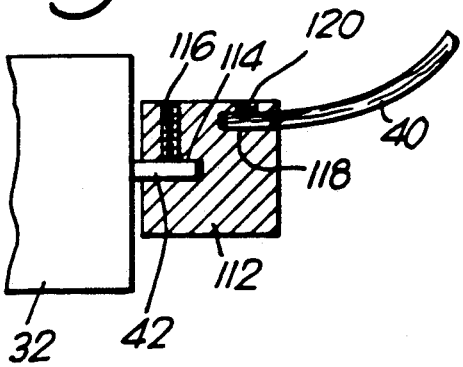
Figure 8:
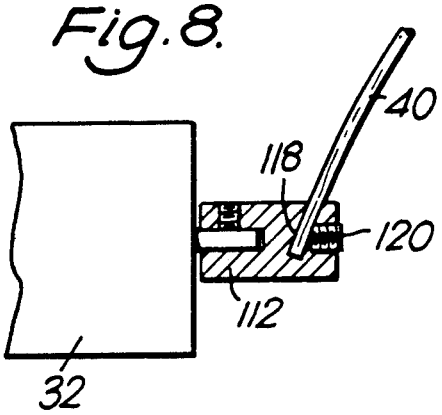

The first and second mounting means 36,38 by which the first and second motors 32,34 are respectively attached to the base are substantially identical. Referring particularly to FIGS. 2,4 and 5, the mounting means each comprise an elongate hollow tube 70 with base and motor attachment means 72,74 at its respective ends. The hollow tube 70 carries power supply wires 73 for the motor 34.

The base attachment means 72, shown in elevation and sectional views in FIGS. 4 and 5 respectively comprises a bracket 76 having horizontal 76H and vertical 76v portions. The horizontal portion 76H is seated on a vibration-absorbing rubber pad 78 which in turn is mounted in an aperture 80 in the upper surface of the base 30 (see FIG. 3). The horizontal portion is secured by a bolt 82 passing through a first washer 84, clearance holes in the horizontal portion 76H and rubber pad 78, and a second washer 86 within the base unit 30 and of larger diameter than the aperture 80 in the upper surface of the base 30. A locking nut 88 engages the end of the bolt 82 and is tightened up against the second washer 86. The bolt 82 has a bore 90 drilled along its axis for the passage of the motor power supply wires 73.

The elongate hollow tube 70 is attached at its lower end to the vertical portion 76v of the bracket 76. A retaining block 92 having a horizontal threaded bore 94 extending therethrough is attached to the vertical portion 76v by a cap screw 96 passing through a washer 98 and a clearance bore in the vertical portion 76v and engaging one end of the retaining block threaded bore 94. When tightened to the required level, the cap screw 96 is glued to prevent it from coming loose. The retaining block 92 has a vertical bore passing through it, intersecting the horizontal threaded bore 94. The lower end of the tube 70 is located in the vertical bore and secured therein by a set screw 100 threadably engaged in the threaded bore 94 and tightened up against the outer surface of the tube 70.

Figure 12:
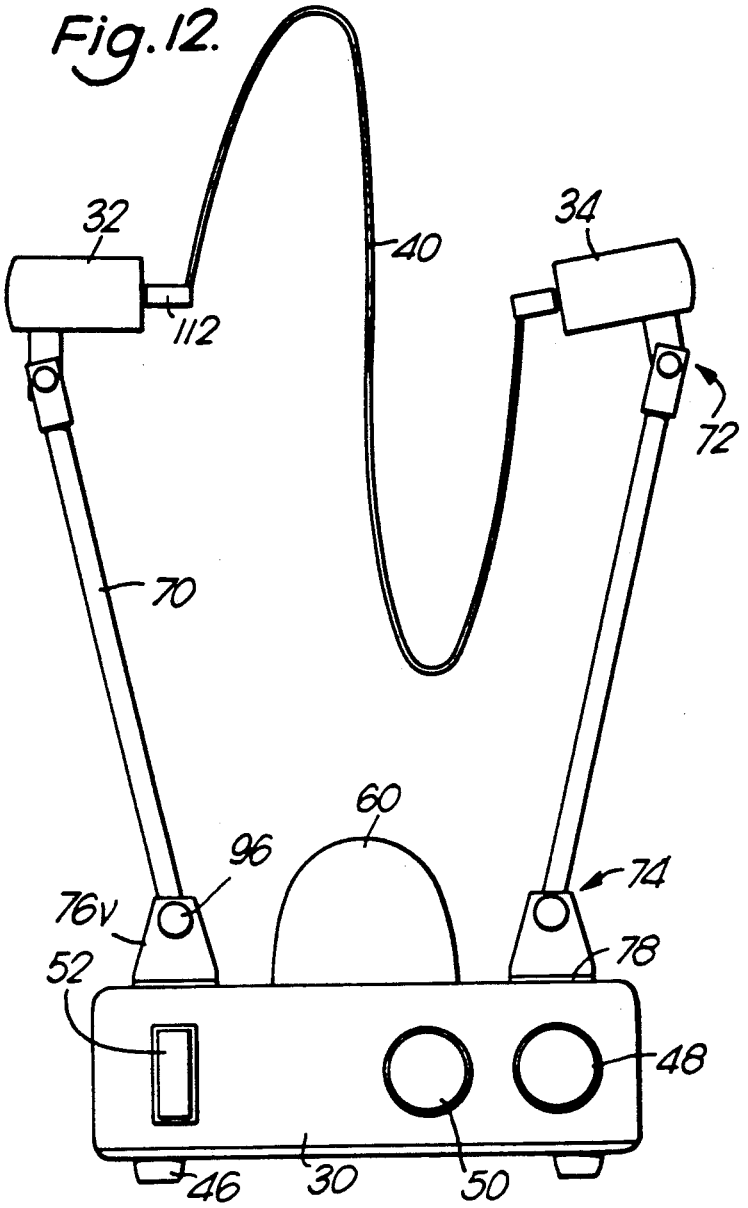
FIG. 12 shows the light sculpture of FIG. 1 with the mounting means and motors in an alternate position.

The attachment of the retaining block 92 to the vertical portion 76V of the bracket 76 permits rotation of the retaining block 92 and tube 70 about the axis of the horizontal threaded bore 94 (as shown in FIG. 12) whilst the friction between the surfaces of the bracket 76 and retaining block 92, due to the cap screw 96, ensures that the tube 70 will remain in a rotated position when so positioned.

The motor attachment means 72 is shown in FIG. 2. The motor 34 is held clamped in a motor housing 102 which is attached to retaining body 104 by means of engagement of a locking unit nut 106 within the motor housing 102 with a threaded portion of the retaining body 104 which protrudes through an clearance hole in the motor housing 102. The retaining body 104 is attached to the upper end of the elongate hollow tube 70 by a bracket 108 having a collar portion and a vertical portion extending therefrom. A cap screw 110 passes through a clearance hole in the vertical portion of the bracket 108 and engages a threaded horizontal bore in the retaining body 104. The provision of the clearance hole in the vertical portion of the bracket 108 allows the motor 34 and retaining body 104 to pivot relative to the tube 70 about the axis of the cap screw 110 (see FIG. 12).

Figure 9:
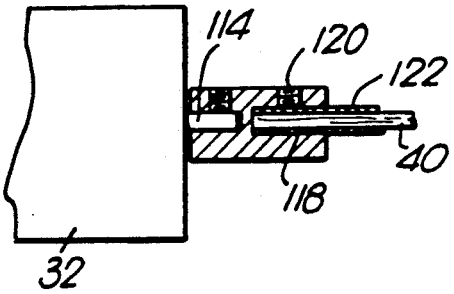
Figure 10:
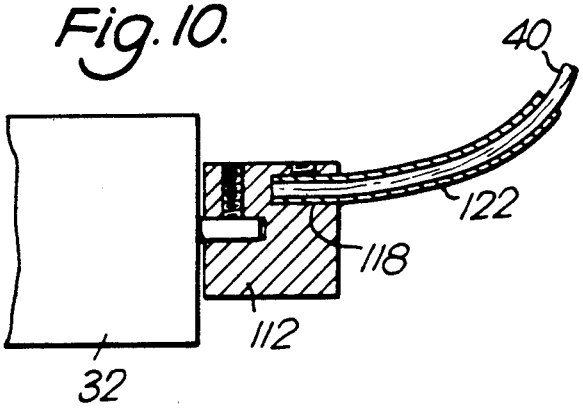
Figure 11:
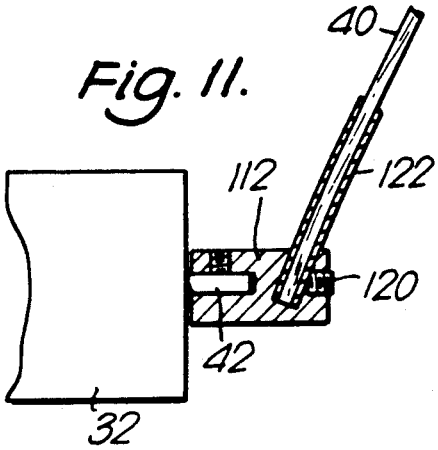

Alternative methods for connection of the nylon cord 40 to the shaft 42 of the first motor 32 are shown in FIGS. 6 to 11. In each case a clamping block 112 is used, the clamping block having a first bore 114 for receiving the motor shaft 42 and a set screw 116 in a transverse threaded bore, the set screw 116 being screwed up against the motor shaft 42 to secure the clamping block 112 thereto. In each case the clamping block 112 has a second bore 118 and set screw 120 arrangement or receiving and securing one end of the nylon cord 40. In a first embodiment (FIG. 6) the first and second bores 114,118 are axially aligned. In a second embodiment (FIG. 7) the second bore 118 is parallel to, but radially offset from, the first bore. In a third embodiment (FIG. 8) the second bore 118 is offset from, and angled with respect to, the first bore 114. The applicant has found this third embodiment to be most suitable. Fourth, fifth and sixth embodiments of the cord-to-motor-shaft connection, shown reslpectively in FIGS. 9,10 and 11 are respectively identical to the first, second and third embodiments, save in that the end of the cord 40 is enclosed in a sheath 122 of rigid or flexible material such as p.v.c. or silicone rubber.

In FIG. 12, the light sculpture of FIG. 1 is shown with the first and second motors 32,34 repositioned by pivoting of the tube 70 at the respective motor and base attachment means 72,74. Although said attachment means 72,74 have been described as permitting pivotal movement about a single axis, it will be apparent to one of ordinary skill in the art that such pivotal joints may be replaced with ball and socket joints permitting a greater range of relative movement between the first and second motors 32,34 and the base 30 to be attained.

Figure 14:
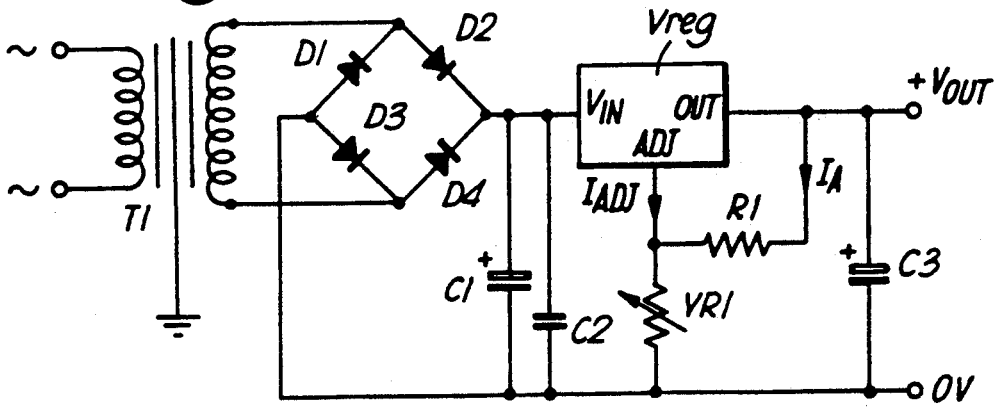
FIG. 14 is a circuit diagram of a motor power supply suitable for the motors of the light sculpture of FIG. 1.

An example of a known type of voltage rectification and regulation circuit, suitable for providing a power supply to the first, second and third motors 32,34,66 is shown in FIG. 14. The circuit comprises a step-down transformer T.1 coupled to receive mains A.C current, a bridge rectifier D1-D4 coupled to the output of transformer T1, smoothing capacitors C1-3, voltage regulator Vreg, resistor R1 and potentiometer VR1. The voltage regulator Vreg and other component values are chosen to provide an output voltage Vout of from 1.25 v to 12 v, varied by adjusting potentiometer VR1. The operation of the individual components in the circuit of FIG. 14 is conventional, forms no part of the present invention and will not be further described.

In a preferred embodiment, two voltage rectification and regulation circuits, as in FIG. 14, are provided the first of which drives the first and second motors 32,34 and the second of which drives the disk motor 66. To permit manual adjustment of the disk and cord rotation speeds, the potentiometers VR1 of the respective circuits are provided with control knobs 48,50 (FIG. 1) on the outside of the base 30. A mains supply on-off switch 52, interupting the supply of mains AC current to the voltage rectification and regulation circuits and the lamp 56, may similarly be provided on the outside of the base 30.

Figure 15:
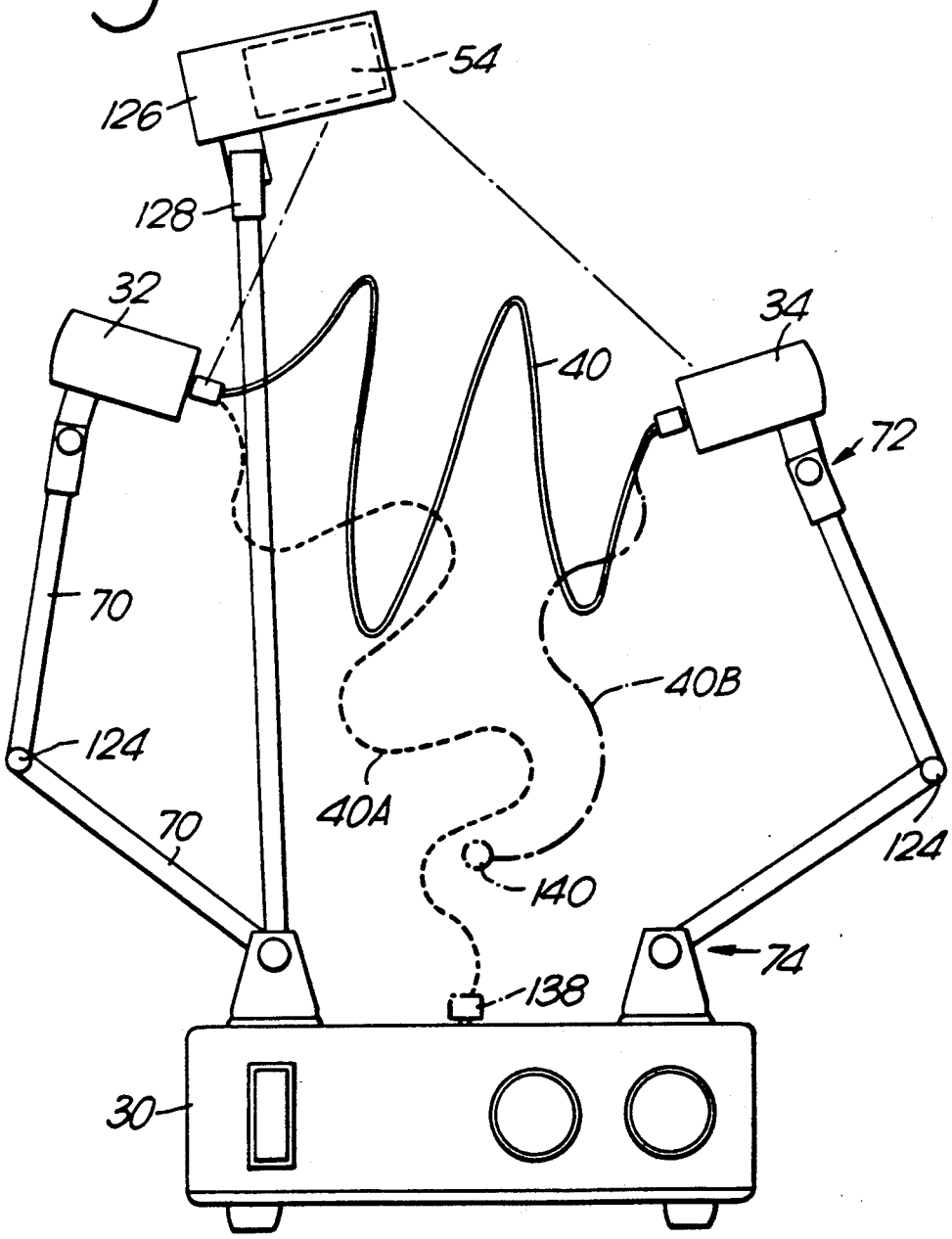
FIG. 15 is a front elevation of a second embodiment of a dynamic light sculpture according to the present invention, showing also in dashed and chain-link lines respectively third and fourth embodiments of a light sculpture according to the present invention.

A second embodiment of a light sculpture according to the present invention is shown in FIG. 15. In many respects it is identical to the first embodiment described with reference to FIGS. 1 to 14 and, where appropriate, the same reference numerals are used to denote parts common to the first and second embodiments.

A first difference of the second embodiment is that an additional joint 124 is provided intermediate the ends of the hollow elongate tube 70, thereby allowing a greater range of relative positions between the first and second motors 32,34 and the base 30 to be achieved.

Figure 17:
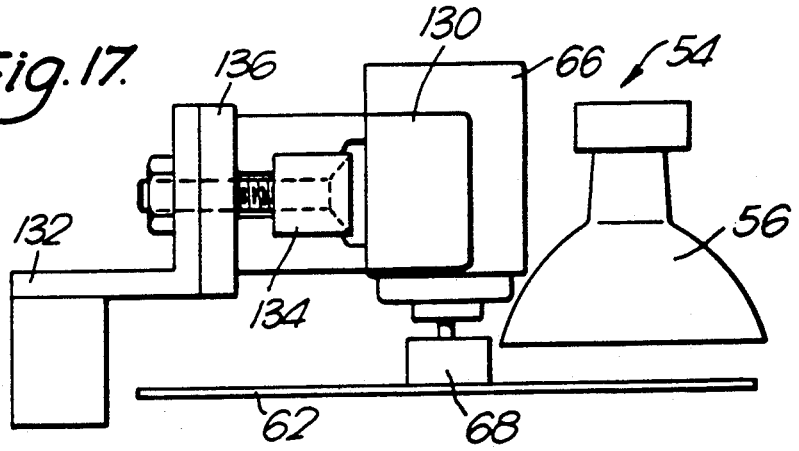
FIG. 17 is a partially sectioned schematic elevation of a first embodiment of illuminating means for the light sculpture of FIG. 15.

A second difference of the second embodiment is that the illuminating means 54 is mounted in a separate housing 126 which is itself mounted to the base 30 on a pivotably attached support arm 128. The illuminating means 54 shown in FIG. 17 is identical to that of the first embodiment save in that it is inverted and illuminates the nylon cord 40 from above. The disk motor 66 may be mounted to the housing 126 by means of a plastics clip 130 secured to an angle bracket 132 by nut and bolt with anti-vibration rubber mounts 134, 136 between the bolt and clip 130 and between the clip 130 and bracket 132. The bracket 132 may be attached to the housing 126 in a number of conventional ways such as by nut and bolt or rivets.

Figure 16:
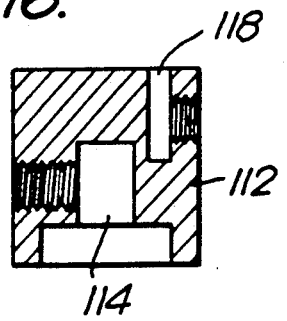
FIG. 16 is a sectioned view through a bush for attachment of the elongate element to the motor shaft in FIG. 15.

The attachment of the ends of the nylon cord 40 to the shafts 42,44 of the first and second motors 32,34 is by means of a clamping block 112 as shown in FIG. 16. The clamping block of FIG. 16 is substantially identical to that of FIG. 10, save in that the first bore 114 is stepped to allow close fitting to a motor having a raised boss around a part of the motor shaft.

A third embodiment of a light sculpture according to the present invention is shown in FIG. 15 with reference to dashed line 40A. In this third embodiment, the second motor and second mounting means are omitted and the end of the nylon cord 40A is rotatably attached to the base 30 by means of a bearing joint 138. In the alternative, second mounting means 38 may be retained and the bearing joint 138 mounted at the upper end thereof.

A fourth embodiment of a light sculpture according to the present invention is shown in FIG. 15 with reference to chain-link line 40B. In this fourth embodiment, the second motor and second mounting means are omitted and a weight 140 is attached to the end of the nylon cord 40B.

Whilst the third and fourth embodiments of the light sculpture described above operate satisfactorily, the applicant has found better visual effects to be produced when two motors (as in the first and second embodiments) are used.

Figure 18:
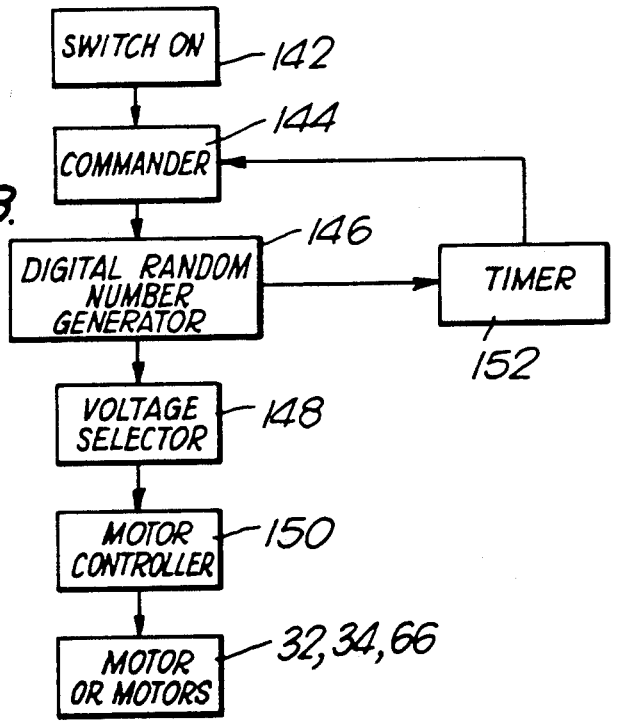
FIG. 18 is a flow chart describing operation of one mode of automatic motor speed control for any of the above embodiments of light sculpture.

A embodiment of a motor control circuit operable to produce successive random changes in motor and/or disk rotation speed will now be described with reference to the flow diagram of FIG. 18. At the first step 142, when the units is switched on, a signal is sent to a first control stage, 144 which commands a digital random number generator 146 to generate a two-byte digital random number. Each odd numbered byte generated is passed to a voltage selector 148 which through a second control stage 150, converts the received odd byte to a voltage level between 1 and 10 volts and supplies this voltage to the motor or motors 32,34,66. The second control stage 150 may include part of the rectification and regulation circuitry of FIG. 14 or may be implemented in other ways known to those skilled in the art.

Each even numbered byte generated by the digital random number generator 146 is passed to a third control circuit 152, including a timer, which converts the even numbered byte to a time interval of between 10 and 40 seconds, counts out the generated time interval and then sends a triggering signal to the first control stage 144. On receipt of the triggering signal the first control stage commands the digital random number generator to generate a further two-byte digital random number. In this way, the voltage supplied to the cord and/or disk motors will be randomly varied at random intervals providing a random series of generated visual effects.

Figure 19:
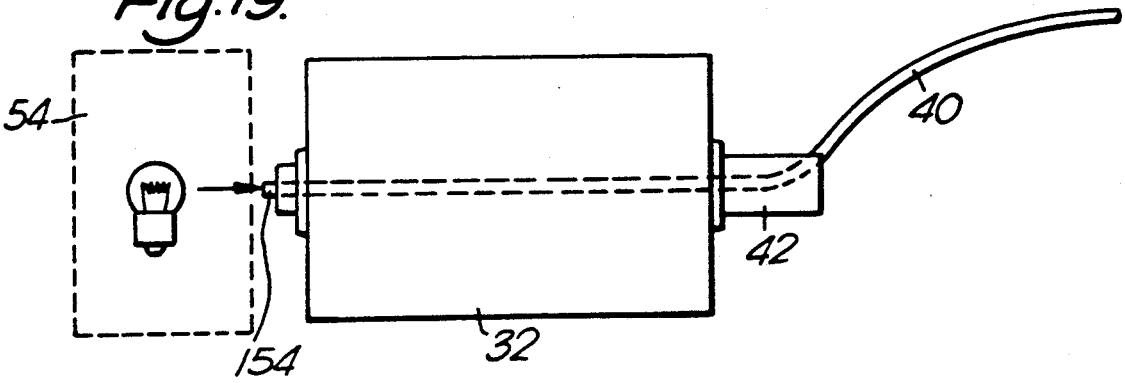
FIG. 19 shows a further method of attachment of the elongate element to the motor shaft, when the elongate element is a fiber optic cable.

A fifth embodiment of a light sculpture according to the present invention will now described with reference to FIG. 19 in which the nylon cord of earlier embodiments is replaced with a length of fiber optic cable 154. Where the fiber optic cable is of a type having a sealed outer surface, the outer surface of the cable 154 is abraided to permit light passing through the cable to escape through the outer surface thereof. In the alternative, a known type of fiber optic cable may be used having an outer surface which permits light to escape therethrough along the length of the cable. A suitable type of this latter form of fiber optic cable is marketed by TBL Fibre Optics Limited of Leeds, England under the designation WN200 Lumenyte 2000. In order to permit light from the illuminating means 54 to enter the end of the cable 154, the shaft of the motor 32 has a bore extending therethrough, with the bared end of the cable protruding from the rear of the shaft. The illuminating means 54 are positioned adjacent the rear of the shaft and may be configured to direct light into the end of the cable 154 in a known manner.

Figure 21:
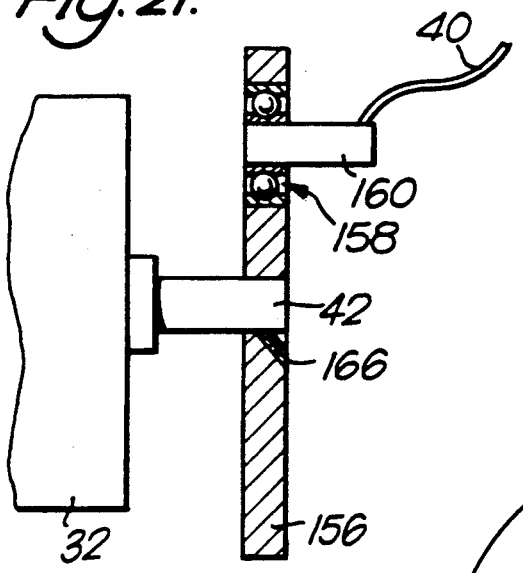
FIGS. 20 and 21 show yet a further method of attachment of the elongate element to the motor shaft, whereby the elongate element is moved but not rotated.

A sixth embodiment of a light sculpture according to the present invention will now be described with reference to FIGS. 20 and 21. In thi0 embodiment, the elongate element may be a nylon cord 40 as described in the first to fourth embodiments and as shown in FIG. 21, or it may be a fiber optic cable 154 the outer surface of which is abraided as described in the fifth embodiment.

The first end of the cord 40 is attached to an idler shaft 160 in like manner to the methods of attachment of cord 40 and clamping block 112 described hereinabove with reference to FIGS. 6 to 11. The idler shaft 160 is rotatably attached to a mounting plate 156, at a position offset from the center thereof, by a bearing joint 158. The bearing joint 158 may suitably be a ball race (as shown) fitted in a correspondingly sized aperture in the mounting plate 156.

The mounting plate 154 has a bore through its center which receives the shaft 42 of the first motor 32. The mounting plate 156 is secured to the shaft 42 by a set screw 166 in a threaded bore of the plate, which threaded bore is positioned to intersect the bore through the center of the plate 156. The configuration of motor shaft 42, mounting plate 156, bearing joint 158 and idler shaft 160 is such that the idler shaft axis, about which the idler shaft 160 can freely rotate, is parallel to the motor shaft axis.

Due to its rotatable attachment to the shaft 42 of the first motor 32, the second end of the cord 40 may be fixedly (non-rotatably) attached to the base 30 or second mounting means 38. alternatively, the second end of the cord 40 may attached to the shaft of a second motor 34 (as in the first and second embodiments), to a bearing joint 138 attached to the base 30 (as in the third embodiment), to a weight 140 (as in the fourth embodiment), or to a bearing joint 158 attached to the shaft of a second motor 34 in like manner to the attchment of the first end of the cord 40 described in the present embodiment.

Where the cord 40 is replaced with a length of fiber optic cable 154 as described above, the second end of the cable is fixedly attached to the base 30 with the illuminating means 54 being located within the base 30 and configured to direct the light emitted thereby into the fiber optic cable 154 through the second end thereof.

Figure 20:
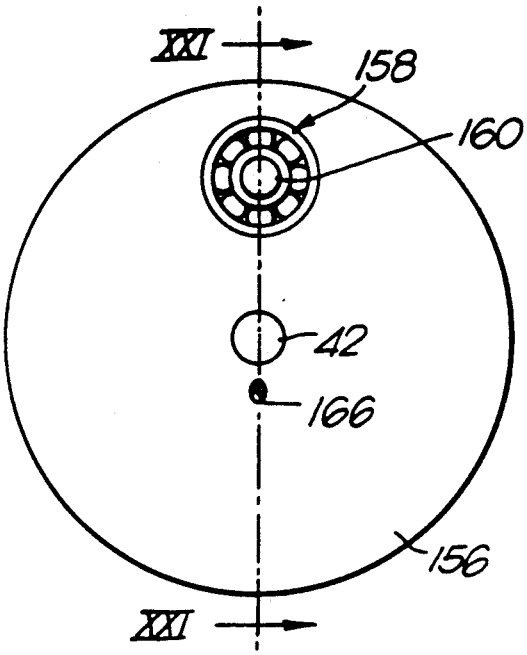

The mounting plate 156 is preferably a disk as shown in FIG. 20. One reason for this preference is that the plate 156 will not appear to move as it is rotated about its center and thus it will not detract from the visual effect of illuminated cord 40 or fiber optic cable 154 which would occur if an assymetrical shape of mounting plate were used.

As an alternative to the dichroic lamp 56 and rotating disk 62 described above, the illuminating means 54 (FIGS. 1,15) may comprise an electronic strobe having two or more flash tubes each of which is separately colored and all of which are controlled to flash at predetermined or random intervals, either separately or in sequence or, if desired, in unison. Control of flash rate for each individual flash tube may, for example, include random number generating circuitry in like manner to the motor control circuit described with reference to FIG. 18.

Figure 22:
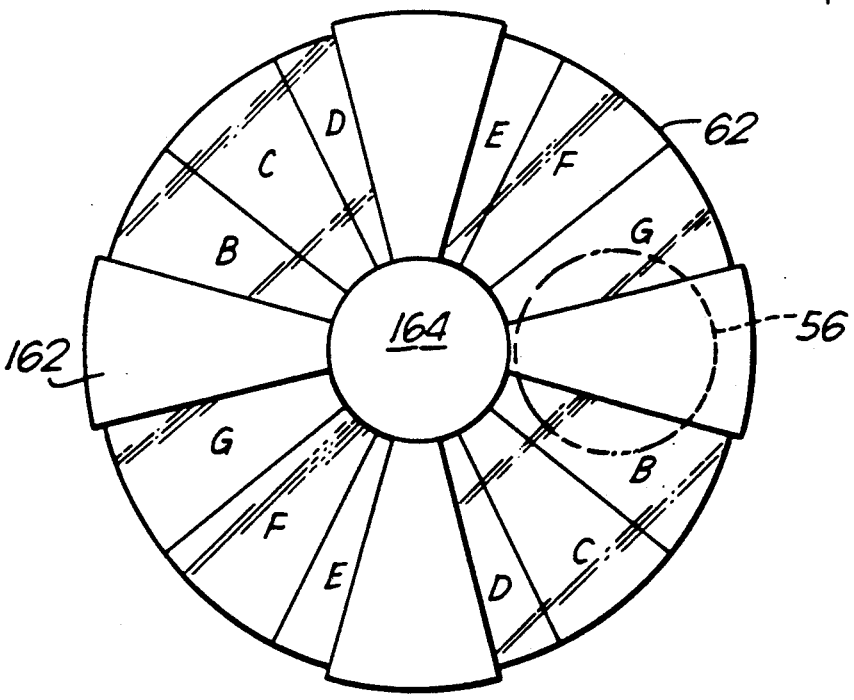
FIG. 22 is a schematic representation of a second embodiment of light means.

A further embodiment of illuminating means comprising the illuminating means 54 described hereinabove with reference to FIGS. 2 and 17 and additional components, will now be described with reference to FIG. 22. The said additional components comprise a blanking plate 162 of opaque material and a fourth motor (blanking plate motor) 164 to which the blanking plate 162 is attached and by which it may be rotated. The blanking comprises a center portion attached to the shaft of the fourth motor 164 and at least one arm portion (although two or more arm portions in balanced configuration are preferred). The blanking plate 162 is positioned such that, when rotated by the fourth motor 164, the arm portion or portions pass over that part of the disk 62 which is over the lamp 56 thereby blanking or blocking the path of the colored light. The disk 62 and blanking plate 162 rotations may be controllably coordinated such that particular colors or groups of colors are allowed to pass while others are blocked. FIG. 22 schematically illustrates one arrangement of blanking plate 162 and disk 62 in which their respective centers are aligned. An alternative arrangement would be with the respective centers offset and only the arm portion of the blanking plate 162 overlapping the disk 62.

Control of the fourth motor 164 may be by any of the motor control means described herein with reference to control of the first second or third motors. In a preferred embodiment, both the third motor (disk motor) 66 and fourth motors (blanking plate motor), 164 are stepper motors, both being computer controlled such that the color is illuminating light and the rate of change of color can both be precisely controlled. In this way, complex series of color changes for the light illuminating the elongate body may be generated.

Although the invention has been described with reference to specific embodiments of a dynamic light sculpture, it will be understood that the foregoing description is not intended to be construed in a limiting sense. Various modifications of the disclosed apparatus as well as alternative applications of the invention may be suggested to persons skilled in the art by the foregoing specification and illustrations. It is therefore considered that the appended claims will cover all such modifications or alternative applications as fall within the true spirit and scope of the invention.

What is claimed is:

1. A dynamic light sculpture, being a structure having at least one moving part and means for illuminating the same, comprising:

a first motor having a motor shaft;

power supply means for supplying power to said first motor;

a base on which said first motor is supported;

a flexible elongate element capable of assuming a multiplicity of different curvilinear shapes and having first and second ends thereof, said first end being coupled with said shaft of said first motor and moved by rotation thereof; and varying-color illuminating means mounted to said base and positioned to illuminate said elongate element with light of varying color.

2. The invention of claim 1, wherein said illuminating means includes a light source and a plate of light transmitting material having at least two regions, are of which is positioned intermediate said light source and said elongate element, said at least two regions being of different coloration and said illuminating means having means for repeatedly changing which of said at least two regions is positioned intermediate said light source and said elongate element.

3. The invention of claim 2, wherein said plate is a disk and each of said at least two regions is a sector thereof, and wherein said means for positioning regions includes a disk motor having a motor shaft coupled to rotate said disk about its center.

4. The invention of claim 3, having means for controlling the speed of rotation of said shaft of said first motor and said shaft of said disk motor to be the same.

5. The invention of claim 3, further comprising first speed control means operable to controllably vary the speed of rotation of said shaft of said disk motor.

6. The invention of claim 3, further comprising first random-control means operable to randomly vary the speed of rotation of said shaft of said disk motor.

7. The invention of claim 2, further comprising a blanking plate of opaque material and means for repeatly moving said blanking plate into and out of a position intermediate said light source and said elongate element.

8. A dynamic light sculpture, being a structure having at least one moving part and means for illuminating the same, comprising:

a first motor having a motor shaft;

power supply means for supplying power to said first motor;

first mounting means to which said first motor is attached and by which said first motor is supported;

a base to which said firsst mounting means is attached;

an elongate element having first and second ends thereof, said first end being coupled with said shaft of said first motor and moved by rotation thereof;

varying-color illuminating means mounted to said base and positioned to illuminate said elongate element with light of varying color, said illuminating means including a light source and a plate of light transmitting material having at least two regions, one of which is positioned intermediate said light source and said elongate element, said at least two regions being of different coloration and said illuminating means having means for repeatedly changing which of said at least two regions is positioned intermediate said light source and said elongate element; and a blanking plate of opaque material and means for repeatedly moving said blanking plate into and out of a position intermediate said light source and said elongate element, said blanking plate comprising at least two arm portions and a central portion of which each of said at least two arm portions is attached and said means for repeatedly moving said blanking plate includes a blanking plate motor having a motor shaft coupled to rotate said blanking plate about its central portion.

9. The invention of claim 1, wherein said base is an enclosure having an aperture in a wall thereof; said illuminating means being located within said enclosure and light emitted by said illuminating passing through said aperture to illuminate said elongate element.

10. A dynamic light sculpture, being a structure having at least one moving part and means for illuminating the same, comprising:

a first motor having a motor shaft;

power supply means for supplying power to said first motor;

first mounting means to which said first motor is attached and by which said first motor is supported;

a base to which said first mounting means is attached;

an elongate element having first and second ends thereof, said first end being coupled with said shaft of said first motor and moved by rotation thereof; and varying-color illuminating means mounted to said base and positioned to illuminate said elongate element with light of varying color, and said elongate element being a length of cord.

11. A dynamic light sculpture, being a structure having at least one moving part and means for illuminating the same, comprising:

a first motor having a motor shaft;

power supply means for supplying power to said first motor;

first mounting means to which said first motor is attached and by which said first motor is supported;

a base to which said first mounting means is attached;

an elongate element having first and second ends thereof, said first end being coupled with said shaft of said first motor and moved by rotation thereof; and varying-color illuminating means mounted to said base and positioned to illuminate said elongate element with light of varying color, said elongate element being a length of fiber optic cable the surface of which is abraided to allow light carried by said cable to escape therethrough, said illuminating means being positioned to illuminate an end face of said fiber optic cable.

12. The invention of claim 1, wherein, at the point of coupling therebetween, said elongate element extends in a direction offset from the axis of said shaft of said first motor.

13. The invention of claim 12, wherein said first end of said elongate element is rotatably attached to said shaft of said first motor.

14. The invention of claim 1, further comprising a weight attached to said second end of said elongate element.

15. A dynamic light sculpture, being a structure having at least one moving part and means for illuminating the same, comprising:

a first motor having a motor shaft;

power supply means for supplying power to said first motor;

first mounting to which said first motor is attached and by which said first motor is supported;

a base to which said first mounting means is attached;

an elongate element having first and second ends thereof, said first end being coupled with said shaft of said first motor and moved by rotation thereof; and varying-color illuminating means mounted to said base and positioned to illuminate said elongate element with light of varying color, and a bearing joint whereby said second end of said elongate element is rotatably connected with said base.

16. A dynamic light sculpture, being a structure having at least one moving part and means for illuminating the same, comprising:

a first motor having a motor shaft;

power supply means for supplying power to said first motor;

first mounting means to which said first motor is attached and by which said first motor is supported;

a base to which said first mounting means is attached;

an elongate element having first and second ends, thereof, said first end being coupled with said shaft of said first motor and moved by rotation thereof; and varying-color illuminating means mounted to said base and positioned to illuminate said elongate element with light of varying color, said first mounting means including at least one jointed portion whereby the position of said first motor relative to said base may be altered by rotation of said first motor about a pivot axis of said at least one jointed portion.

17. A dynamic light sculpture, being a structure having at least one moving part and means for illuminating the same, comprising:

a first motor having a motor shaft;

power supply means for supplying power to said first motor;

first mounting means to which said first motor is attached and by which said first motor is supported;

a base to which said first mounting means is attached;

an elongate element having first and second ends thereof, said first end being coupled with said shaft of said first motor and moved by rotation thereof; and varying-color illuminating means mounted to said base and positioned to illuminate said elongate element with light of varying color, and further comprising a second motor connected to a said power supply means and having a motor shaft coupled with said second end of said elongate element; and second mounting means to which said second motor is attached and by which said second motor is supported, said second mounting means being attached to said base.

18. The invention of claim 17, wherein said first motor and said second motor are substantially identical and are connected in parallel to said power supply whereby said shaft of said first motor and said shaft of said second motor are driven to rotate at substantially the same speed.

19. The invention of claim 17, wherein said second mounting means includes at least one jointed portion whereby the position of said second motor relative to said base may be altered by rotation of said second motor about a pivot axis of said at least one jointed portion.

20. The invention of claim 1, further comprising speed control means operable to controllably vary the speed or rotation of said shaft of said first motor by control of the power supplied to said first motor.

21. The invention of claim 20, further comprising random-control means operable to randomly vary the speed of rotation of said shaft of said first motor.

22. A dynamic light sculpture, being a structure having at least one moving part and means for illuminating the same, comprising:

a first motor having a motor shaft;

power supply means for supplying power to said first motor;

first mounting means to which said first motor is attached and by which sair first motor is supported;

a base to which said first mounting means is attached;

an elongate element having first and second ends thereof, said first end being coupled with said shaft of said first motor and moved by rotation thereof; and varying-color illuminating means mounted to said base and positioned to illuminate said elongate element with light of varying color, said elongate element being a length of fiber optic cable having an outer surface which permits light to escape therethrough along the length of said cable, said illuminating means being positioned to illuminate an end face of said fiber optic cable.

* * * * *

UNITED STATES PATENT AND TRADEMARK OFFICE

CERTIFICATE OF CORRECTION

PATENT NO. : 5 097 394

DATED : March 17, 1992

INVENTOR(S) : Paul A. Friedlander

It is certified that error appears in the above-identified patent and that said Letters Patent is hereby corrected as shown below:

Column 10, line 3; change "are" to ---one---.
line 12; after "positioning" insert ---said---.
line 39; change "firsst" to ---first---.
line 60; change "of" to ---to---.

Column 11, line 1; after "illuminating" insert ---means---.
line 59; after "mounting" insert ---means---.

Column 12, line 13; delete the comma after the word "ends".
line 43; change "to a said" to ---to said---.
line 64; change "or" to ---of---.

Column 13, line 8; change "sair" to ---said---.

Signed and Sealed this

Twenty-eighth Day of September, 1993

Bruce Lehman

*Attest:*

BRUCE LEHMAN

*Attesting Officer*

*Commissioner of Patents and Trademarks*